US007038621B2

(12) United States Patent
Gabriel et al.

(10) Patent No.: US 7,038,621 B2
(45) Date of Patent: May 2, 2006

(54) ANTENNA ARRANGEMENT WITH ADJUSTABLE RADIATION PATTERN AND METHOD OF OPERATION

(75) Inventors: Roland Gabriel, Griesstätt (DE); Maximilian Göttl, Frasdorf (DE); Jörg Langenberg, Prien A. Chiemsee (DE); Jürgen Rumold, Bad Endorf (DE)

(73) Assignee: Kathrein-Werke KG, Rosenheim (DE)

( * ) Notice: Subject to any disclaimer, the term of this patent is extended or adjusted under 35 U.S.C. 154(b) by 15 days.

(21) Appl. No.: 10/635,011

(22) Filed: Aug. 6, 2003

(65) Prior Publication Data

US 2005/0030249 A1 Feb. 10, 2005

(51) Int. Cl.
*H01Q 3/26* (2006.01)

(52) U.S. Cl. ..... 342/372; 342/373

(58) Field of Classification Search ..... 342/368, 342/373, 372; 455/276.1
See application file for complete search history.

(56) References Cited

U.S. PATENT DOCUMENTS

| | | | | |
|---|---|---|---|---|
| 2,531,419 | A * | 11/1950 | Fox | 333/134 |
| 2,913,723 | A | 11/1959 | Thourel | |
| 3,267,472 | A | 8/1966 | Fink | |
| 3,419,821 | A * | 12/1968 | Jones | 333/101 |
| 3,710,329 | A * | 1/1973 | Mailloux et al. | 342/373 |
| 3,769,610 | A | 10/1973 | Savarin et al. | |
| 4,063,243 | A | 12/1977 | Anderson et al. | |
| 4,063,250 | A * | 12/1977 | Fenwick | 342/374 |
| 4,129,870 | A | 12/1978 | Toman | |
| 4,612,547 | A | 9/1986 | Itoh | |
| 4,667,201 | A | 5/1987 | Itoh | |
| 5,081,433 | A * | 1/1992 | Erickson et al. | 332/103 |
| 5,115,248 | A | 5/1992 | Roederer | |
| 5,151,706 | A | 9/1992 | Roederer et al. | |
| 5,512,914 | A | 4/1996 | Hadzoglou et al. | |
| 5,686,926 | A | 11/1997 | Kijima et al. | |
| 5,923,296 | A | 7/1999 | Sanzgiri et al. | |
| 5,929,804 | A | 7/1999 | Jones et al. | |
| 5,936,577 | A * | 8/1999 | Shoki et al. | 342/373 |
| 6,078,824 | A | 6/2000 | Sogo | |
| 6,768,456 | B1 * | 7/2004 | Lalezari et al. | 342/373 |
| 6,850,130 | B1 * | 2/2005 | Gottl et al. | 333/161 |
| 6,864,837 | B1 | 3/2005 | Runyon et al. | |
| 6,922,169 | B1 | 7/2005 | Moh'd Izzat et al. | |

(Continued)

FOREIGN PATENT DOCUMENTS

DE 101 04 564 C1 2/2001

(Continued)

OTHER PUBLICATIONS

J.D. Kraus et al., Antennas for All Applications, 3rd Ed., McGraw Hill, p. 64 and 347, 2002.*

*Primary Examiner*—Thomas H. Tarcza
*Assistant Examiner*—F H Mull
(74) *Attorney, Agent, or Firm*—Nixon & Vanderhye P.C.

(57) ABSTRACT

An improved antenna arrangement is distinguished by the following features: at least two antenna element systems are provided and each has at least one antenna element, which are arranged offset with respect to one another, at least in the horizontal direction, the at least two antenna element systems transmit and receive at least in one common polarization plane, a network is provided, via which the at least two antenna element systems can be supplied with a signal ($A_{in1}$, $A_{in2}$) with an intensity or amplitude which can be set differently or which can be adjusted relative to one another and preferably with a different phase angle.

17 Claims, 15 Drawing Sheets

U.S. PATENT DOCUMENTS

| | | | | |
|---|---|---|---|---|
| 2003/0073463 | A1* | 4/2003 | Shapira | 455/562 |
| 2004/0038714 | A1* | 2/2004 | Rhodes et al. | 455/276.1 |
| 2004/0090286 | A1 | 5/2004 | Runyon | |
| 2004/0160361 | A1* | 8/2004 | Izzat et al. | 342/360 |

FOREIGN PATENT DOCUMENTS

| | | | |
|---|---|---|---|
| DE | 101 05 150 | A1 | 8/2002 |
| JP | 62-224102 | | 10/1987 |
| JP | 2000101326 | | 4/2000 |
| WO | WO 97/06576 | | 2/1997 |
| WO | WO 00/39894 | | 7/2000 |
| WO | WO 01/06595 | A2 | 1/2001 |
| WO | WO 01/13459 | A1 | 2/2001 |
| WO | WO 02/05383 | A1 | 1/2002 |
| WO | WO 02/19470 | A1 | 3/2002 |
| WO | WO 02/50953 | A1 * | 6/2002 |

* cited by examiner

ANTENNA ARRANGEMENT WITH ADJUSTABLE RADIATION PATTERN AND METHOD OF OPERATION

FIELD

The technology herein relates to an antenna arrangement and to a method for its operation.

BACKGROUND AND SUMMARY

The mobile radio antennas provided for a base station normally have an antenna arrangement with a reflector in front of which a large number of antenna elements are provided, offset with respect to one another in the vertical direction. These antenna elements may, for example, transmit and receive in one polarization or in two mutually perpendicular polarizations. The antenna elements may be designed to receive in only one frequency band. The antenna arrangement may, however, also be in the form of a multiband antenna, for example for transmitting and receiving in two frequency bands with an offset with respect to one another. In principle, so-called triband antennas are also known.

As is known, mobile radio networks have a cellular form, with each cell having a corresponding associated base station with at least one mobile radio antenna for transmitting and receiving. The antennas are in this case designed such that they generally transmit and receive at a specific angle to the horizontal with a component pointing downwards, thus defining a specific cell size. This depression angle is also referred to, as is known, as the down-tilt angle.

In this context, a phase shifter arrangement has already been proposed in WO 01/13459 A1, in which the down-tilt angle can be adjusted in a continuously variable manner for a single-column antenna array with two or more antenna elements arranged one above the other. According to this prior publication, differential phase shifters are used for this purpose, and, when set differently, result in the delay time length and hence the phase shift at the two outputs of each phase shifter being set to a different direction, thus allowing the depression angle to be adjusted.

In this case, the setting and adjustment of the phase shifter angle is carried out manually or by means of a remotely controllable retrofitted unit, as is known by way of example from DE 101 04 564 C1.

When the so-called traffic density varies or, for example, a further base station adjacent to one cell is added to the antenna, then retrospective matching to changes in the characteristics can be carried out by preferably remotely controllable depression of a down-tilt angle, and by reducing the size of the cell.

However, such a change to a down-tilt angle is not the only or adequate solution for all situations.

Thus, for example, there are mobile radio antennas which have a fixed horizontal polar diagram, for example with a 3 dB beamwidth of 45°, 65°, 90° etc. In this case, matching to location-specific characteristics is impossible since it is not possible to change the polar diagram in the horizontal direction retrospectively.

However, in principle, mobile radio base station antennas also exist with polar diagrams which can be varied by means of intelligent algorithms in the base station. This necessitates, for example, the use of a so-called Butler matrix (via which, for example, an antenna array can be operated with two or more individual antenna elements which, for example, are arranged with a vertical offset one above the other in four columns). Antenna arrangements such as these are, however, enormously complex in terms of the antenna supply lines between the base station on the one hand and the antenna or the antenna elements on the other hand, with a dedicated feed cable being required for each column, and with two high-quality antenna cables being required for each column for so-called dual-polarized antennas, which are polarized at +45° and −45°, with an X-shaped alignment. This leads to a high cost price and to expensive installation. Finally, the base station also needs to have very complex algorithm circuits, thus once again increasing the overall costs.

An antenna arrangement with capabilities for power splitting and for setting different phase angles for the signals which can be supplied to the individual antenna elements has in principle also been disclosed in WO 02/05383 A1. The antenna comprises a two-dimensional antenna array with antenna elements and with a feed network. The feed network has a down-tilt phase adjusting device and an azimuth phase adjusting device with a device for setting the antenna element width (the width of the lobe). The beam width is varied by appropriately splitting the power differently between the antenna elements, which are offset with respect to one another in the horizontal direction. Phase shifter devices are provided in order to set a different azimuth beam direction, in order to set the emission direction appropriately.

The present illustrative exemplary non-limiting implementation provides an antenna arrangement and a method for its operation, which allows shaping of the polar diagram, particularly in the horizontal direction, and especially also in the form of a polar diagram change which can also be carried out retrospectively. This is preferably intended to be possible with little complexity for the feed cables that are required.

The solution according to the illustrative exemplary non-limiting implementation is thus based on the idea that the antenna has at least two antenna systems, each having at least one antenna element, that is to say, for example, at least in each case one antenna element, with the entire transmission energy now being supplied either to only one of the two antenna systems or else now being adjustable to achieve a different division of the power, as far as a 50:50 split of the power energy between the two antenna systems. Depending on the different components of the power that is supplied, this makes it possible to vary the polar diagram shape, particularly in the horizontal direction, and to vary the 3 dB beamwidth of an antenna from, for example 30° to 100°. In addition, the phase shifters which are provided allow the phase angle of the signals to be varied, in order to achieve a specific polar diagram shape.

If, for example, the at least two antenna elements are arranged in a preferred manner with the horizontal offset alongside one another on a common reflector, that is to say they transmit and receive in a common polarization plane, then this allows the horizontal polar diagram of the antenna to be adjusted. If, by way of example, the signals are supplied to an antenna array having at least two columns and having two or more antenna elements which are each arranged one above the other, then different horizontal polar diagrams can be produced for this antenna array, depending on the intensity and phase splitting.

The technology herein makes it possible, for example, to produce asymmetric horizontal polar diagrams, to be precise even when considered in the far field. It is also possible to produce horizontal polar diagrams for which, although they are symmetrical, that is to say they are arranged symmetrically with respect to a plane that runs vertically with respect to the reflector plane, the transmission signals are emitted with only a comparatively low power level in this vertical plane of symmetry. It is thus also possible to produce, for example, two, four etc. main lobes that are symmetrical with respect to this plane but which transmit more to the left and more to the right with an angled alignment position and, in between them preferably in the plane which is vertical with respect to the reflector plane, and which would intrinsically correspond to the main emission plane in the normal case, with the antenna arrangement transmitting with a considerably lower power level.

However, it is equally possible to produce horizontal polar diagrams which, for example, have an odd number of main lobes and in this case, if required, are arranged symmetrically with respect to a plane which runs at right angles to the reflector plane. In this case, one main lobe direction may preferably be located in the vertical plane of symmetry, or in a plane at right angles to the reflector plane. At least one further main lobe is in each case located on the left-hand side and on the right-hand side of the plane that is at right angles to the reflector plane. The intensity minima which are located between them may, for example, be reduced only by less than 10 dB, in particular by 6 dB or less than 3 dB. The antenna arrangement according to the illustrative exemplary non-limiting implementation and its operation thus make it possible to illuminate specific zones with a higher transmission intensity, depending on the special features on site, and in the process effectively to "mask out" other areas, or to supply them with only reduced radiation intensity. This offers advantages particularly when the horizontal polar diagram is adapted in areas in which there are schools, kindergartens etc., such that these areas are illuminated only very much more weakly.

In one illustrative exemplary non-limiting implementation, provision is even made for a different polar diagram shape to be produced for an antenna on the one hand for transmission and, in contrast to this, for reception. In other words, the horizontal polar diagrams for transmission and reception have different shapes. It is thus possible by means of a horizontal polar diagram which is optimally matched to the environment according to the illustrative exemplary non-limiting implementation to be used to take into account the fact, for transmission, that sensitive facilities such as kindergartens, schools, hospitals, etc. in the transmission zone are located in an area or zone which is supplied with only reduced intensity by a mobile radio antenna while, in contrast, the horizontal polar diagram for reception is designed such that the arriving signals can be received with correspondingly optimally designed horizontal polar diagrams throughout the entire coverage area of a corresponding mobile radio antenna in a cell.

The intensity and phase splitting according to the illustrative exemplary non-limiting implementation are preferably achieved by using a phase shifter arrangement, that is to say at least one phase shifter and preferably a differential phase shifter, and downstream hybrid circuit, in particular a 90° hybrid. This results, for example, in a signal which is supplied to a phase shifter and has a predetermined intensity being split between the two outputs of the differential phase shifter such that the intensities of the signals at the two outputs are the same, but their phases are different. If these two signals are supplied to the two inputs of a downstream 90° hybrid, then this now results in the phases once again being the same at the output of the hybrid, although the intensities or amplitudes of the signals are different. The amount of power which is supplied to the at least two phase shifters can in this way be split from, for example 1:0 to 1:1 by different phase settings on the phase shifter. The phase angle can also be influenced and the direction of the polar diagram varied by a further optional phase shifter which can be connected downstream.

In summary, the following advantages, by way of example, may be achieved by the system according to the illustrative exemplary non-limiting implementation:

- Allowing location-specific antenna polar diagrams to be produced on site.
- If required, the antenna polar diagram can be varied again and again at any time, for example when a new network plan is provided, without any need to replace the antenna itself.
- During commissioning, the antenna polar diagram can be adapted easily, for example by remote control in the base station. No manual changes to the antenna on the pylon, such as alignment of the antenna etc., are required for this purpose, thus drastically reducing the costs.
- Preset polar diagrams can easily be produced by means of fixed parameters, which can be preset, in the controller.
- It is also possible to use an automatic control system to produce different polar diagrams at different times (for example as a function of given differences in the supply for the respective location as a function of other times of day, for example in the morning and in the evening, etc.).
- The base stations can still be used even if the system according to the illustrative exemplary non-limiting implementation is upgraded. All that is required is simple replacement of the antenna on the base station.
- Different polar diagrams can be produced for transmission and reception.
- In particular, it is possible to supply sensitive areas with less power and other areas with more power.
- Asymmetric horizontal polar diagrams can be produced.
- Symmetrical horizontal polar diagrams can be produced, which have a number of superimposed main lobes such that the power in the first, second and for example, third lobes in three different azimuth directions in the horizontal polar diagram differ in terms of their power levels by less than 50%, in particular less than 40%, 30% or else less than 20% or even 10%.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
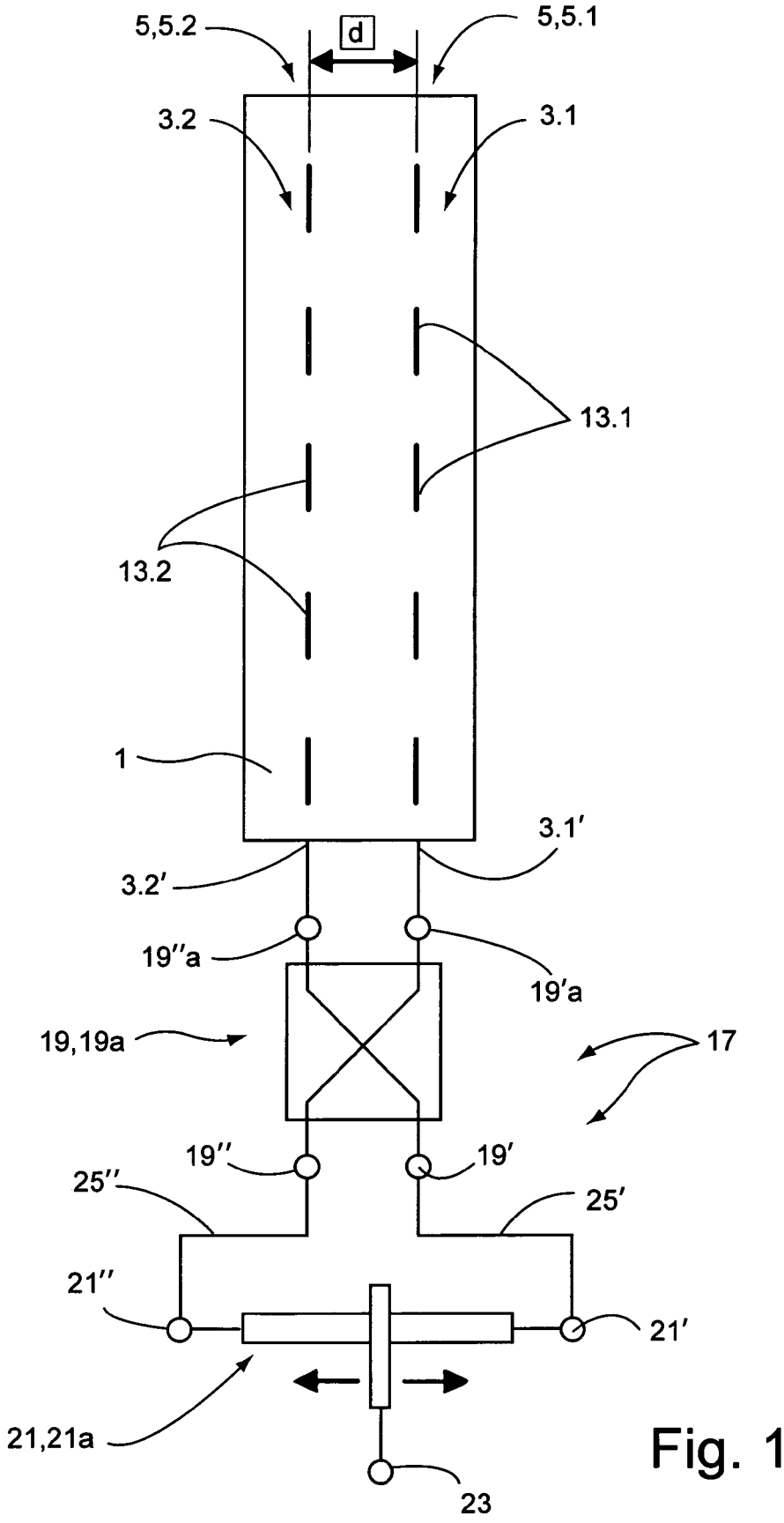
FIG. 1 shows a schematic view of an antenna arrangement according to the illustrative exemplary non-limiting implementation with an upstream network for shaping the horizontal polar diagram.

The antenna arrangement shown in FIG. 1 has a reflector 1, in front of which two antenna systems 3.1, 3.2 are formed. In the illustrated exemplary non-limiting implementation, the antenna arrangement has two columns 5, that is to say a column 5.1 and a column 5.2, in each of which respective antenna elements 13.1 and 13.2 are arranged. In the illustrated exemplary non-limiting implementation, these antenna elements 13.1 and 13.2 may, for example, each be formed from five dipole antenna elements which are arranged one above the other, are aligned vertically and, in the illustrated exemplary non-limiting implementation, are arranged in the two columns at the same height and with a lateral separation d which can be predetermined. An antenna arrangement is thus described which, by way of example, transmits and receives in one polarization plane in one frequency band.

The antenna arrangement in the illustrated exemplary non-limiting implementation is fed via a network 17 which, in the illustrated exemplary non-limiting implementation, has a hybrid circuit 19, that is to say specifically a 90° hybrid 19*a* and an upstream phase shifter or phase adjusting arrangement 21, which in the illustrated exemplary non-limiting implementation is also formed from a differential phase shifter 21*a*.

The network input 23 is supplied, for example, with a signal $PS_{in}$. When the phase shifter is in its neutral mid-position, then the signals $PS_{out1}$ and $PS_{out2}$ are produced in phase and with the same intensity at its two outputs 21' and 21".

The two phase shifter outputs 21' and 21" are connected via lines 25' and 25" to the inputs 19' and 19" of the hybrid circuit 19. The outputs 19'*a* and 19"*a* of the hybrid circuit 19 are then connected to the two antenna inputs 3.1' and 3.2'.

The operation and the method of operation are in this case such that the two antenna systems 3.1 and 3.2, that is to say the antenna elements 13.1 and 13.2, can be supplied with signals of the same intensity or with different intensity components by adjusting the phase shifter, with all of the power being supplied to only the antenna elements in one column in an extreme situation while, in contrast, the other column is disconnected completely.

When the phase shifter 21 is in its neutral initial position, that is to say in the mid-position shown in FIG. 1, then the signals at the output of the phase shifter are, of course, in phase but with the same intensity, so that the output signals $H_{out1}$, and $H_{out2}$ are also likewise in phase and have the same intensity.

However, if the phase shifter is now, by way of example, adjusted in one direction or the other as shown by the arrow 27, then this results in the output signals $PS_{out1}$, and $PS_{out2}$ at the output of the phase shifter now being at different phase angles, but having the same intensity. The hybrid coupler 19 in turn causes the signals once again to be produced in phase but with different amplitudes at its outputs 19'*a* and 19"*a*, and thus at the inputs 3.1' and 3.2' to the antenna system. In other words, a different phase setting on the phase shifter 21 is converted to a different intensity split at the input of the two columns of the two antenna systems 3.1, 3.2.

The capabilities which this results in will be explained in more detail with reference to the following figures.

Figure 2:
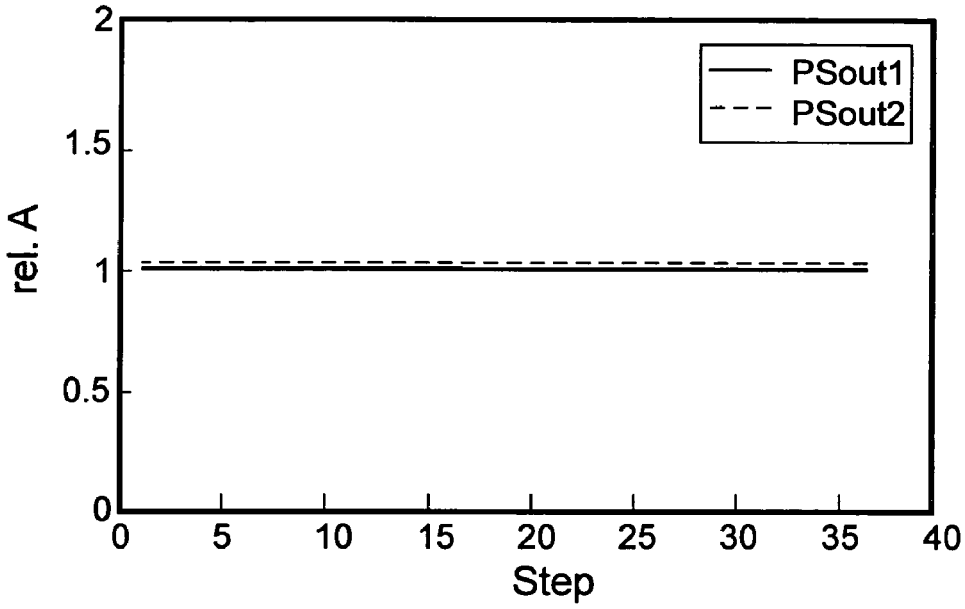
FIG. 2 shows a diagram to explain the amplitude value of the two output signals at the outputs of the phase shifter that is shown in FIG. 1.

FIG. 2 will now be used to show for the various settings of the phase shifter that the relative intensity split (that is to say the relative amplitude A) of the two output signals from the phase shifter remains the same for all settings, that is to say $PS_{out1}$ and $PS_{out2}$ are always the same. This means that the signal 1:1 which is fed in at the input of the phase shifter 23 is split between the two outputs of the phase shifter 21' and 21", but these components have different phase angles depending on the position of the phase shifter 21.

Figure 3:
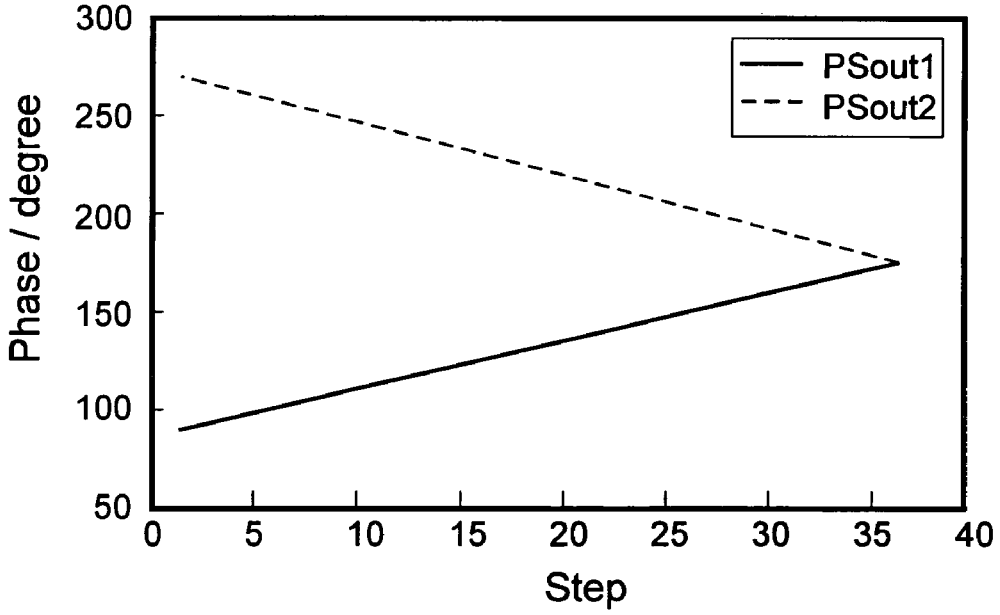
FIG. 3 shows a diagram to illustrate the different phase angles of the two output signals at the two outputs of the phase shifter that is shown in FIG. 1.

However, the phase angle of the signals $PS_{out1}$ and $PS_{out2}$ from the phase shifter varies, as shown in the illustration in FIG. 3, depending on the various settings.

Figure 4:
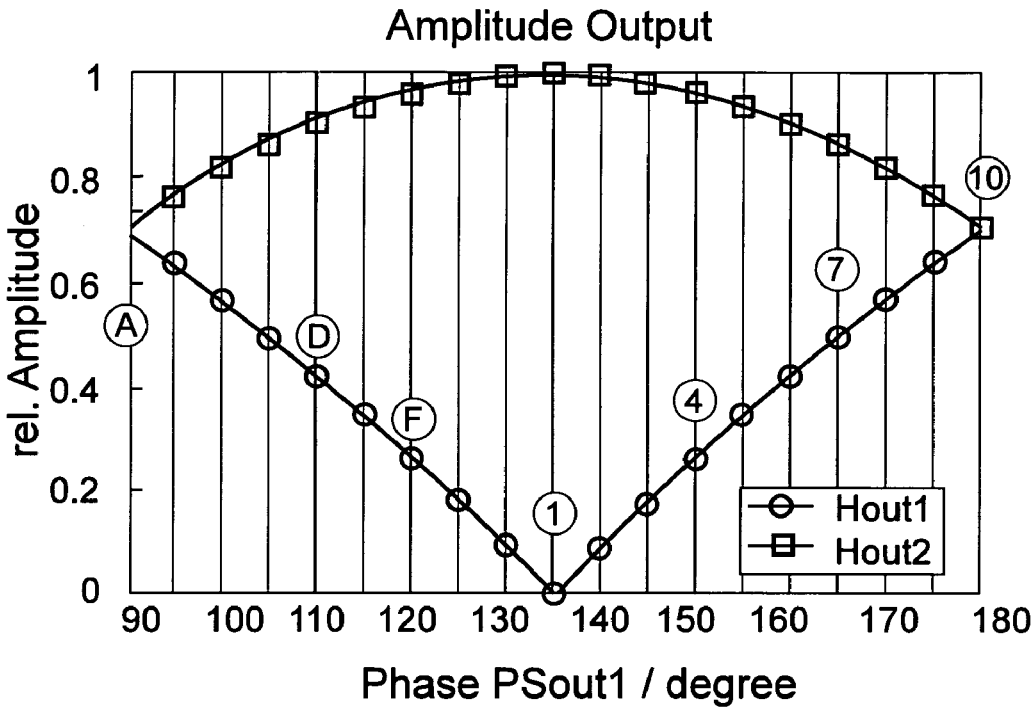
FIG. 4 shows a diagram to illustrate the amplitude value of each of the two outputs of the hybrid circuit shown in FIG. 1.
Figure 5:
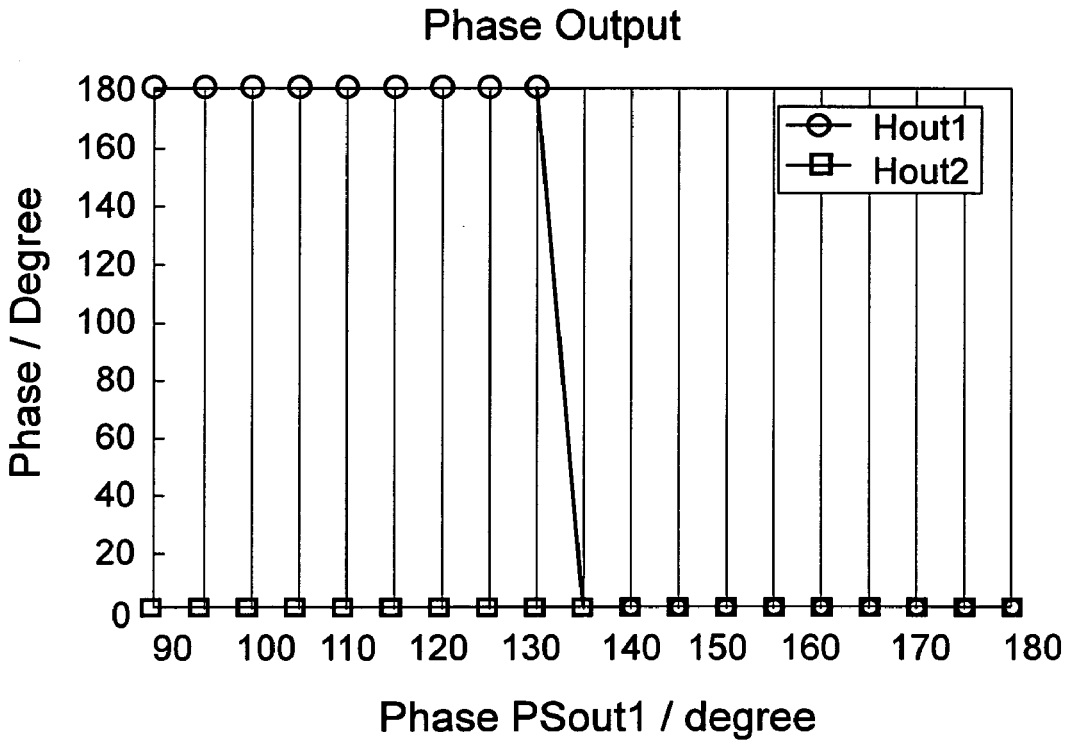
FIG. 5 shows a diagram to illustrate the phase angles of the output signals at the two outputs of the hybrid circuit shown in FIG. 1.

These different phase angles in the end lead, at the output of the hybrid circuit 19, to characteristics such as those illustrated in FIGS. 4 and 5. When the phase shifter is in its neutral mid-position (in which the output signals are in phase), then this represents the situation indicated by the number 10 in FIG. 4. This means that the output signals from the hybrid circuit 19 are once again in phase and have the same intensity.

However, if the phase shifter is now adjusted from its neutral mid-position, then, for example, the intensity of the output signal $H_{out1}$ at one output 19'*a* of the hybrid circuit 19 decreases while, in contrast, the other output signal $H_{out2}$ at the other output of the hybrid circuit 19 increases. The intensity changes and profiles shown in FIG. 4 in this case lie on a section of a sine or cosine curve. Continuous further adjustment in this case allows the signal to be moved, for example, from the position identified by the number 10 via the position identified by the number 7, and then from the position identified by the number 4 to the position identified by the number 1, in which the signal $H_{out2}$ has the value 0 and, at the other output, the signal, $H_{out1}$ assumes the maximum value, or 100% value. During the movement from the position with the number 10 to the position with the number 1, this always ensures that the output signals from the hybrid circuit, and thus the input signals to the antenna array, are in phase.

Figure 6:
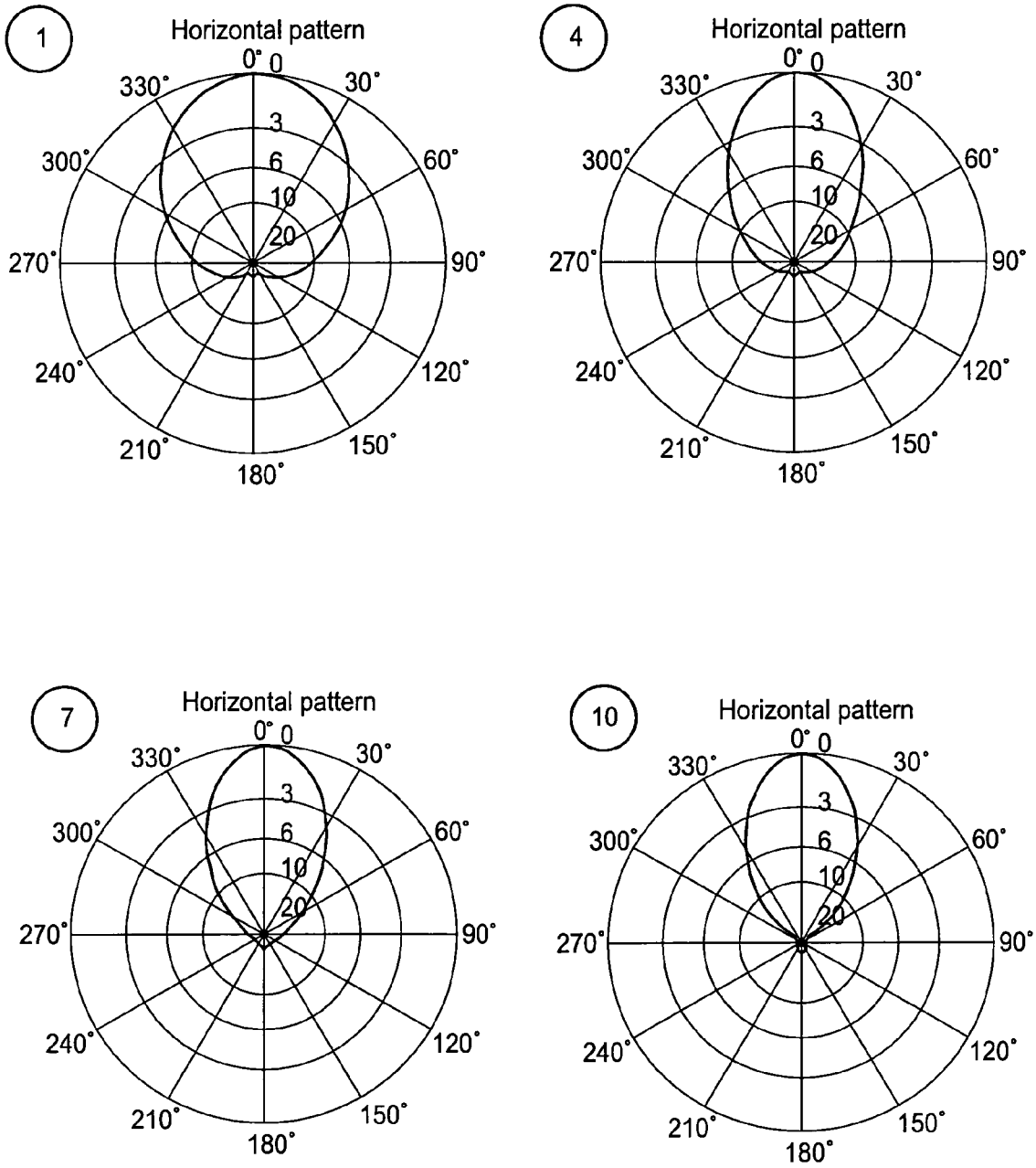
FIG. 6 shows various horizontal polar diagrams which can be achieved using the apparatus according to the illustrative exemplary non-limiting implementation as shown in FIG. 1, with the phase shifter settings annotated by numbers in FIG. 4.

The steps which have been mentioned allow, for example, the horizontal polar diagrams shown in FIGS. 6.1, 6.4, 6.7 and 6.10 to be provided for the antenna setting. In this case, the drawings show only the relative changes in the horizontal width of the polar diagrams. Any desired intermediate positions are likewise possible by means of the other setting options for the phase shifter, and these are not shown in detail only for the sake of simplicity.

Figure 7:
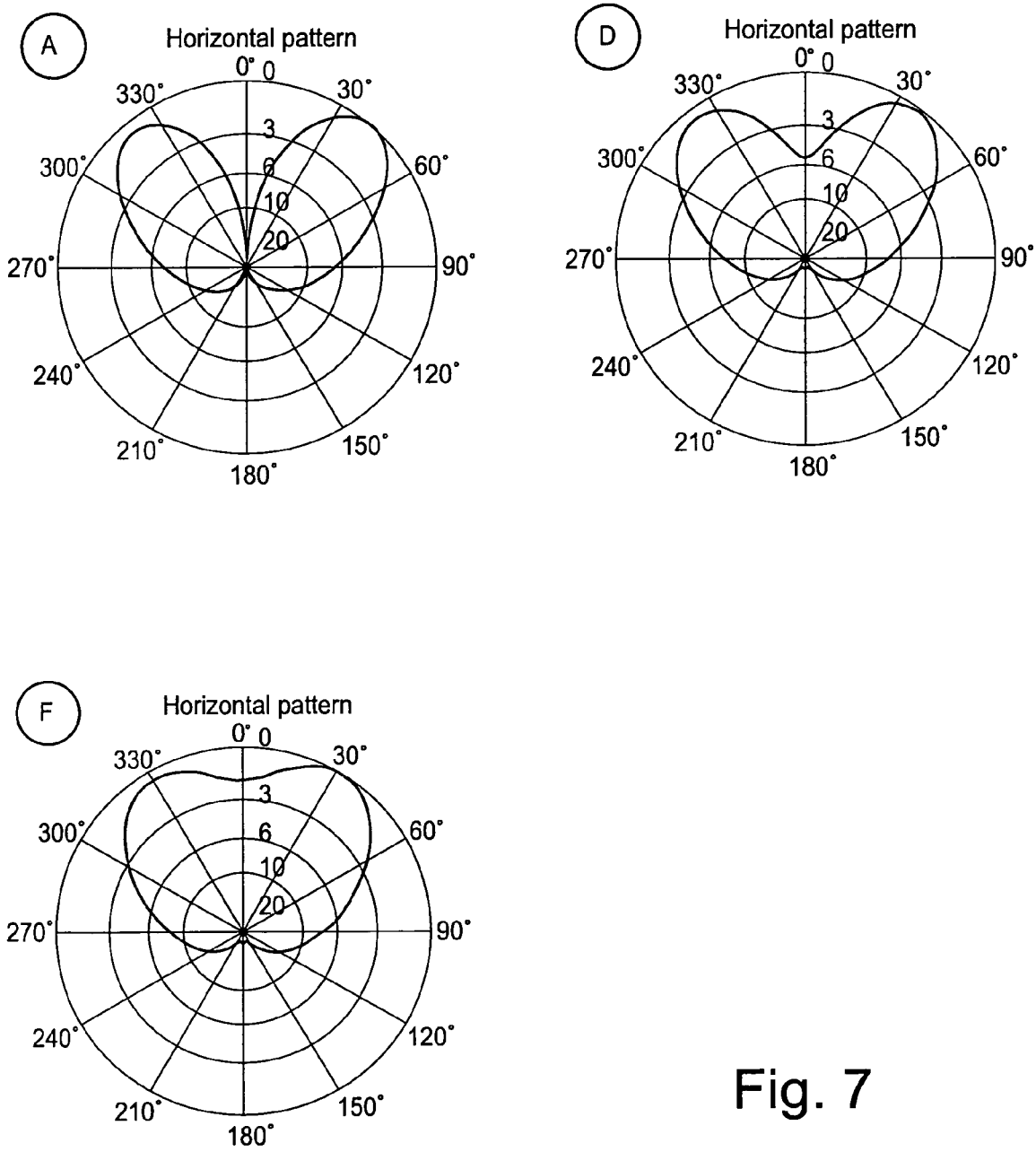
FIG. 7 shows further horizontal polar diagrams which can be produced using the antenna arrangement according to the illustrative exemplary non-limiting implementation as shown in FIG. 1, with the phase shifter settings annotated by letters in FIG. 4.

Now, however, the phase shifter setting can be varied even further, specifically as shown in FIG. 4 to the setting values in the left-hand half of the diagram with the consequence that this results in a phase shift of 180° in this case (FIG. 5). In other words, the output signals at the output of the hybrid circuit 19 are now no longer in phase, but have a phase shift of 180° with respect to one another. If the phase shifter is now set, for example, to the position F, to the position D or to the position A, then this results in the setting values as shown in FIGS. 7.A, 7.D and 7.F, respectively. This also shows that horizontal polar diagram shaping which is matched to the local characteristics can be carried out by extreme variability with very simple means.

However, the system can also be provided with further variation and adjustment options.

Figure 8:
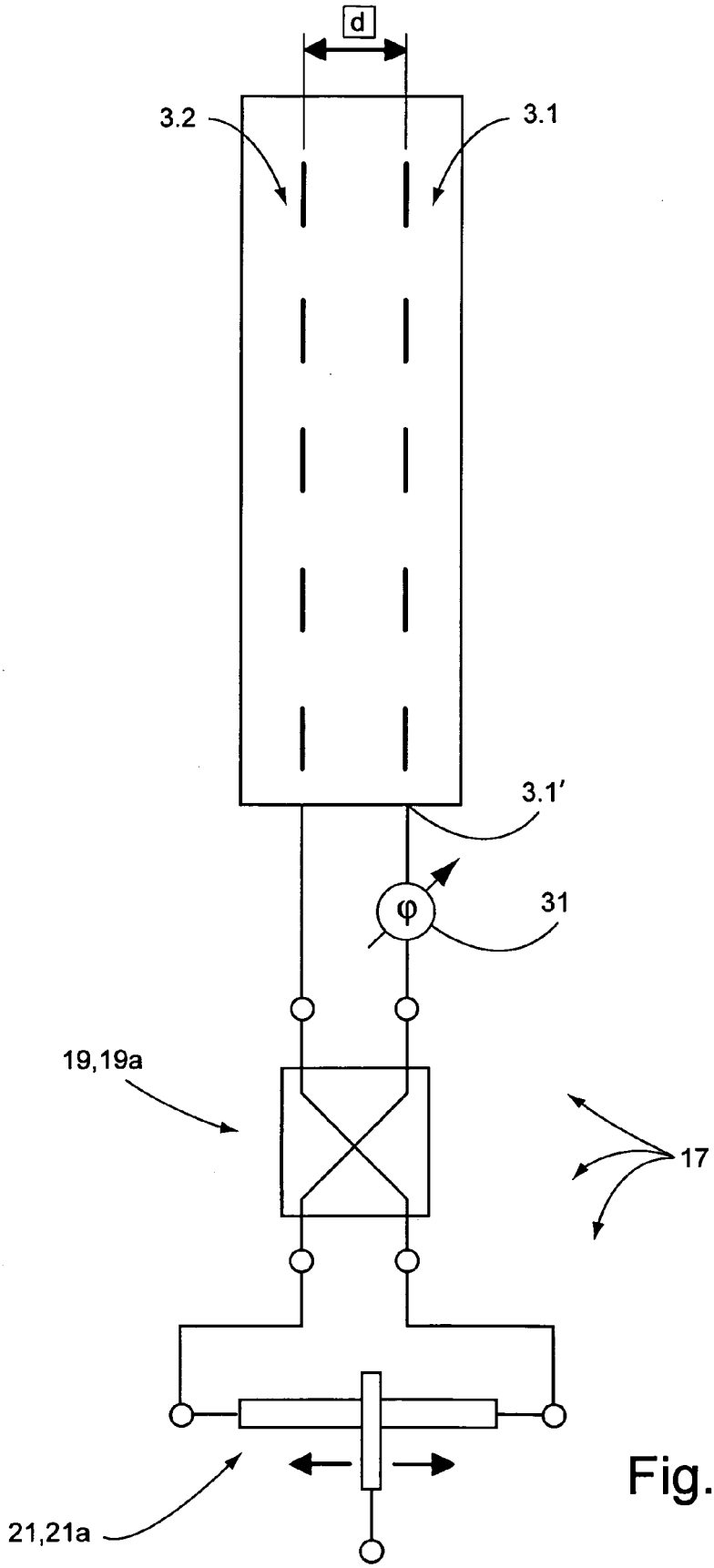
FIG. 8 shows an exemplary non-limiting implementation, modified from that shown in FIG. 1, with an additional phase adjusting element between the hybrid circuit and the antenna array.

FIG. 8 shows an antenna arrangement which in principle corresponds to the exemplary non-limiting implementation shown in FIG. 1, and which has a comparable network 17. However, in this case, the network 17 also has a phase adjusting device 31 which, in the illustrated exemplary non-limiting implementation, is arranged between one output 19'*a* of the hybrid coupler 19 and the associated input 3.1' of the antenna system 3.

Figure 9:
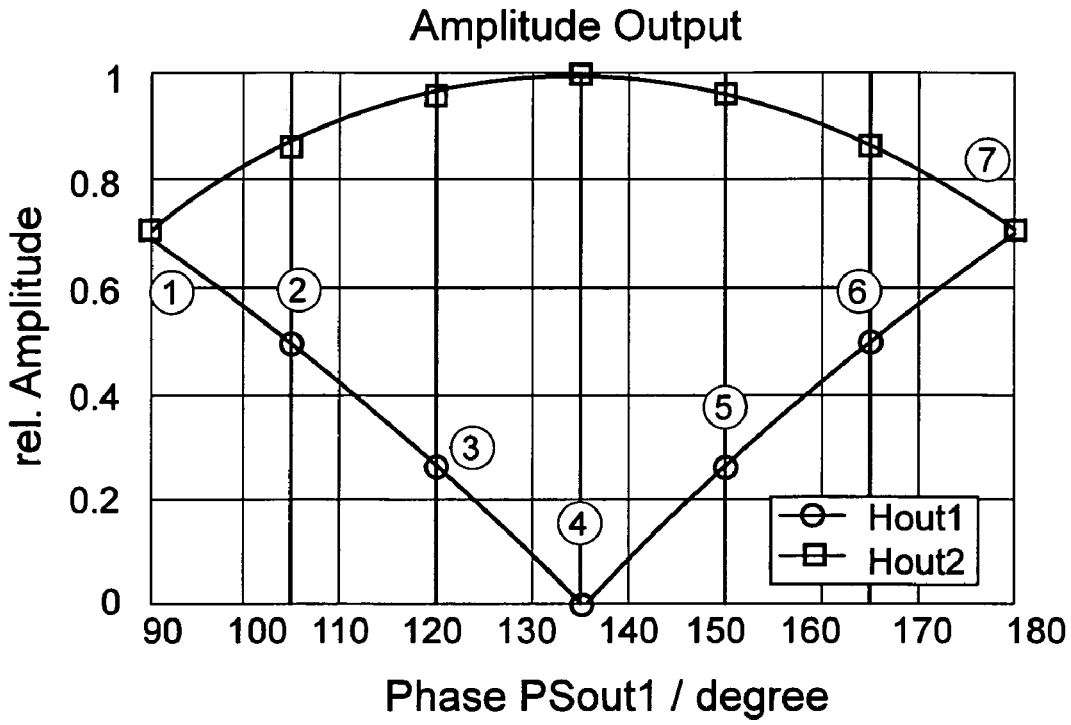
FIG. 9 shows a diagram to illustrate the amplitudes of the two output signals at the output of the hybrid circuit shown in FIG. 8.
Figure 10:
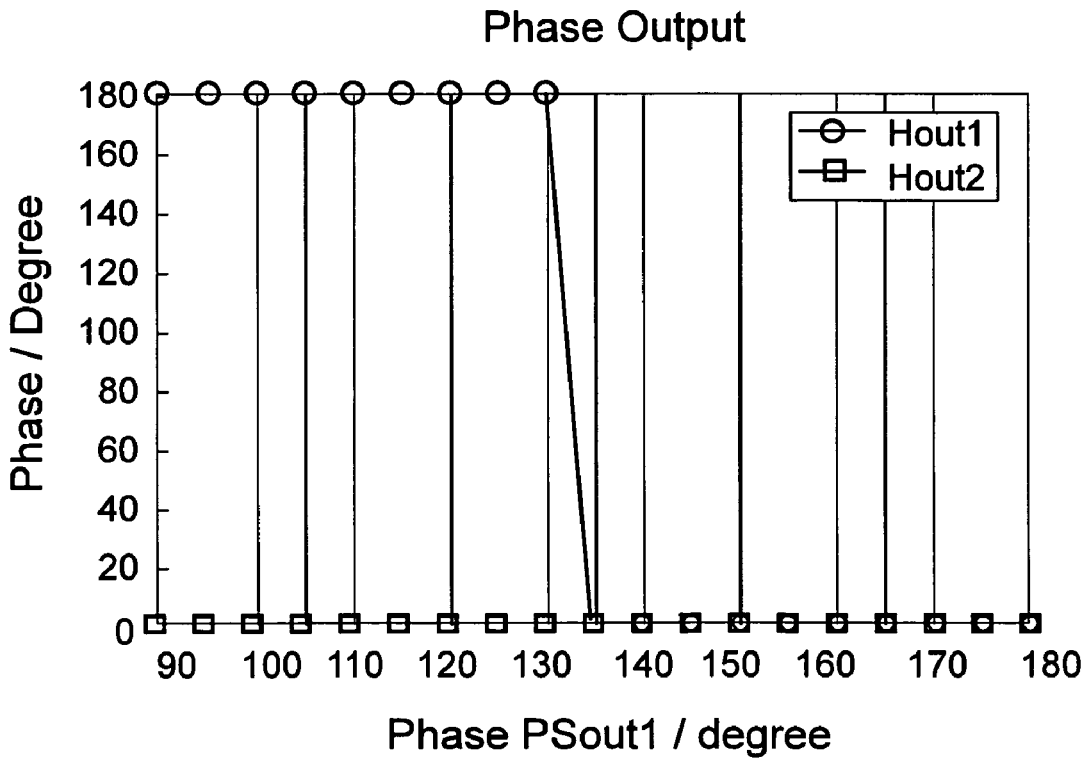
FIG. 10 shows a diagram to illustrate the phase angles of the two output signals at the output of the hybrid circuit shown in FIG. 8.
Figure 11:
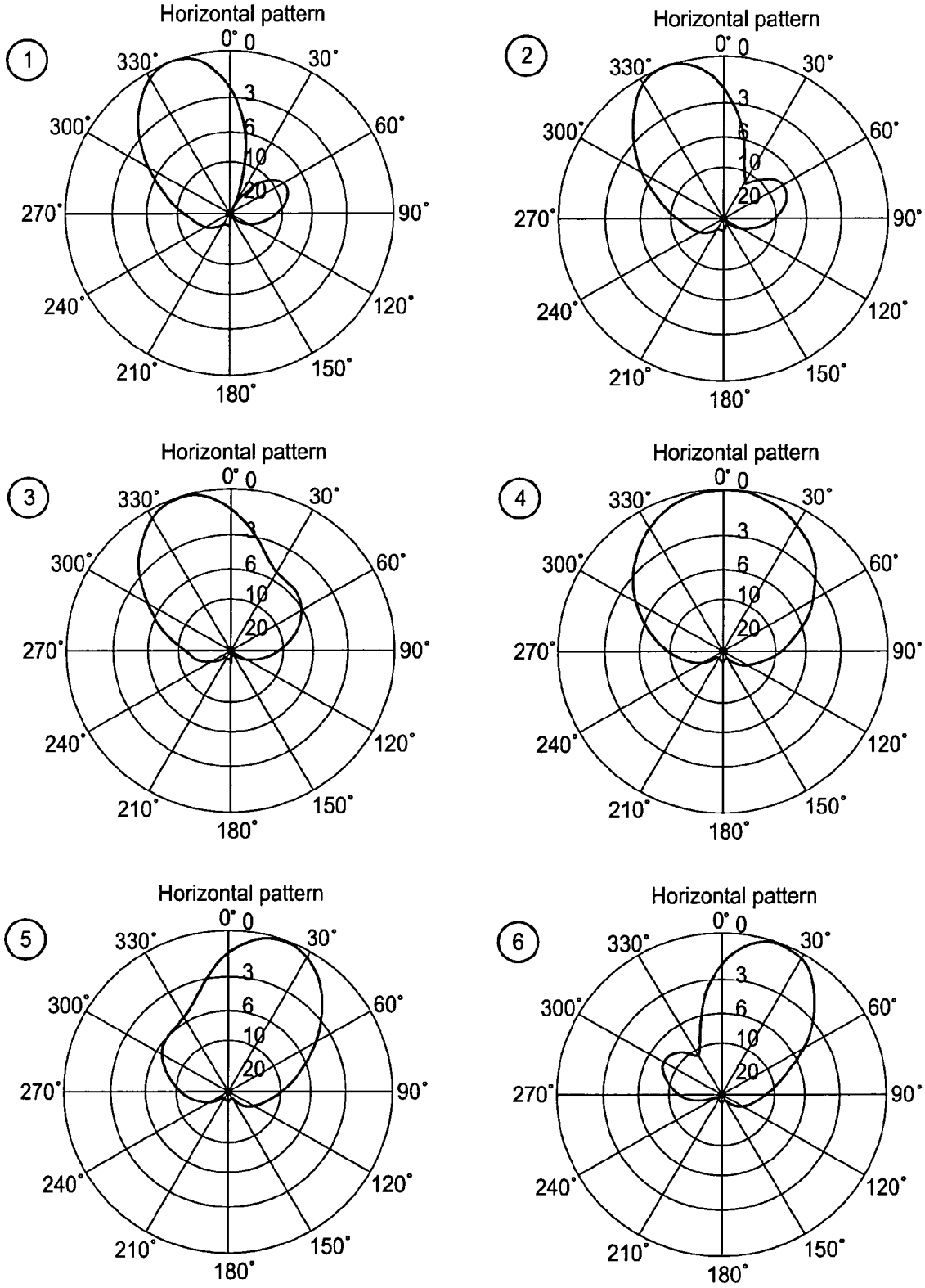
FIG. 11 shows various horizontal polar diagrams which can be produced using the apparatus according to the illustrative exemplary non-limiting implementation shown in FIG. 8, with the phase shifter settings annotated by numbers in FIG. 9.

From the explanation of the previous exemplary non-limiting implementation, it is clear that the output signals $H_{out1}$, and $H_{out2}$ are in principle in phase or have a phase shift of 180°, and that, in the end, the signal intensities can be set differently by setting the phase shifters differently. The circuit illustrated in FIG. 8 now also results in the capability to produce an additional relative phase shift between the signals $H_{out1}$ and $H_{out2}$ which are supplied to the two antenna columns 5. This phase shifter element 31 may be used, for example, to produce a phase delay, with the consequence that, for example, horizontal polar diagrams can then be produced on the basis of the output signals $H_{out1}$ and $H_{out2}$ from the hybrid coupler 19 corresponding to the diagrams shown in FIGS. 9 and 10 (which in principle correspond to the diagrams shown in FIGS. 4 and 5), as can be produced on the basis of the different phase shifter settings shown in FIGS. 11.1 to 11.6, and as shown by the numbers "1" to "7" in FIG. 9. The horizontal polar diagrams shown in FIGS. 11.1 to 11.6 can then be produced by setting the additional phase shift in the phase adjusting element 31 to 90°. If other settings are used for the phase shift in the phase adjusting element 31, then further horizontal polar diagram shaping can be carried out. In the simplest case, this phase adjusting element 31 may be formed from an additional piece of line.

A further extension to an antenna system 3 with a four-column antenna array will now be described with reference to FIG. 12. In this case as well, the horizontal polar diagram is shaped using only a single phase shifter 21, although the signals $PS_{out1}$, and $PS_{out2}$ which are produced at the outputs 21' and 21" are now split into a total of four signals $H_{in}$ via a downstream branch or addition point 35' or 35", respectively, so that the two first inputs A, B are now supplied with the signal coming from one phase shifter output, in phase and with the power split equally in a corresponding manner, while the two other inputs C and D are supplied with the signals coming from the other phase shifter output, in phase in a corresponding manner and with the power split equally in a corresponding manner. In this non-limiting implementation, the four inputs A to D represent the inputs of a Butler matrix 119 which, in principle, comprises four hybrid circuits 19, specifically in each case two hybrid circuits in two series-connected stages, in each of which one output of an upstream hybrid circuit is connected to the input of a downstream hybrid circuit in the same column, and the respective other output of an upstream hybrid circuit is connected to the input of the second hybrid circuit in the second downstream stage.

The four outputs I, II, III and IV of the Butler matrix 119 which forms the hybrid circuit are then connected to the four corresponding inputs of the antenna system 3, which lead to the antenna elements 13.1, 13.2, 13.3 and 13.4 in the four columns 5.1, 5.2, 5.3, 5.4, and feed these antenna elements.

For simplicity in the illustrated exemplary non-limiting implementation, it has once again been assumed that all the antenna elements 13 transmit and receive in a vertical polarization plane.

Figure 13:
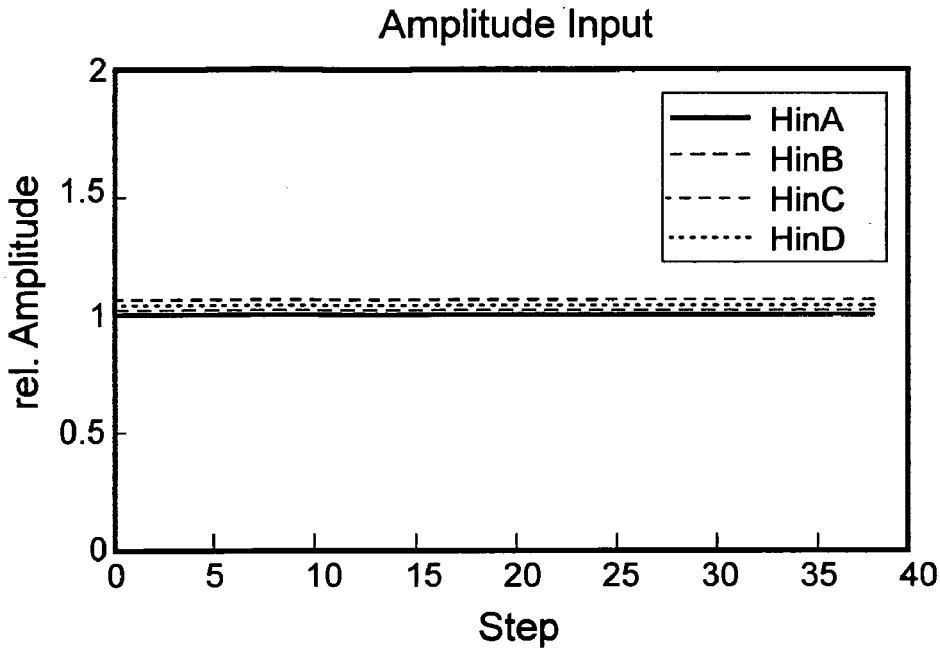
FIG. 13 shows a diagram to illustrate the amplitude values of the input signals to the Butler matrix, for the exemplary non-limiting implementation shown in FIG. 12.
Figure 14:
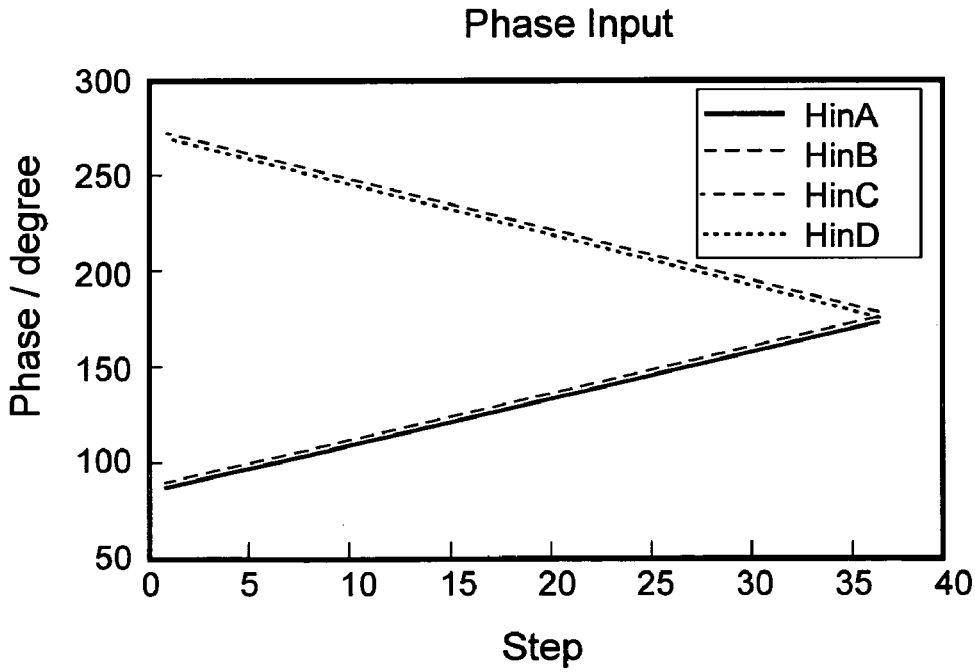
FIG. 14 shows a diagram to illustrate the phase angles of the input signals to the Butler matrix.

The in-phase signals $H_{inA}$ and $H_{inB}$ as well as the two signals $H_{inC}$ and $H_{inD}$, which are likewise in phase with one another but whose phase differs from the phase of the former signals, can now be produced at the inputs to the Butler matrix 119 by varying the setting of the phase shifter 21, as shown in the illustration in FIG. 14. All four signals in this case have the same intensity, as is shown in FIG. 13.

Signals $H_{out}$ which are in phase overall can then once again be produced, corresponding to the phase settings, at the outputs I to IV and thus at the corresponding column inputs of the antenna array, with these signals being in phase or having a phase shift of 180°, although once again they have different intensities to one another, as will now be described with reference to FIGS. 15 and 16.

Figure 15:
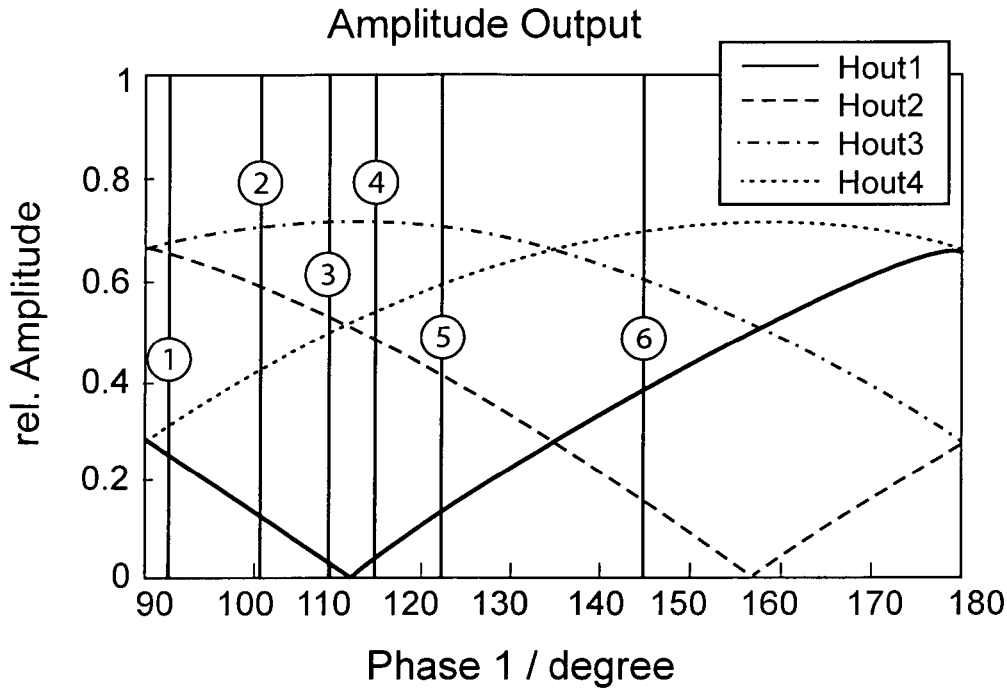
FIG. 15 shows a diagram to illustrate the output signals at the output of the Butler matrix for the exemplary non-limiting implementation shown in FIG. 12.
Figure 16:
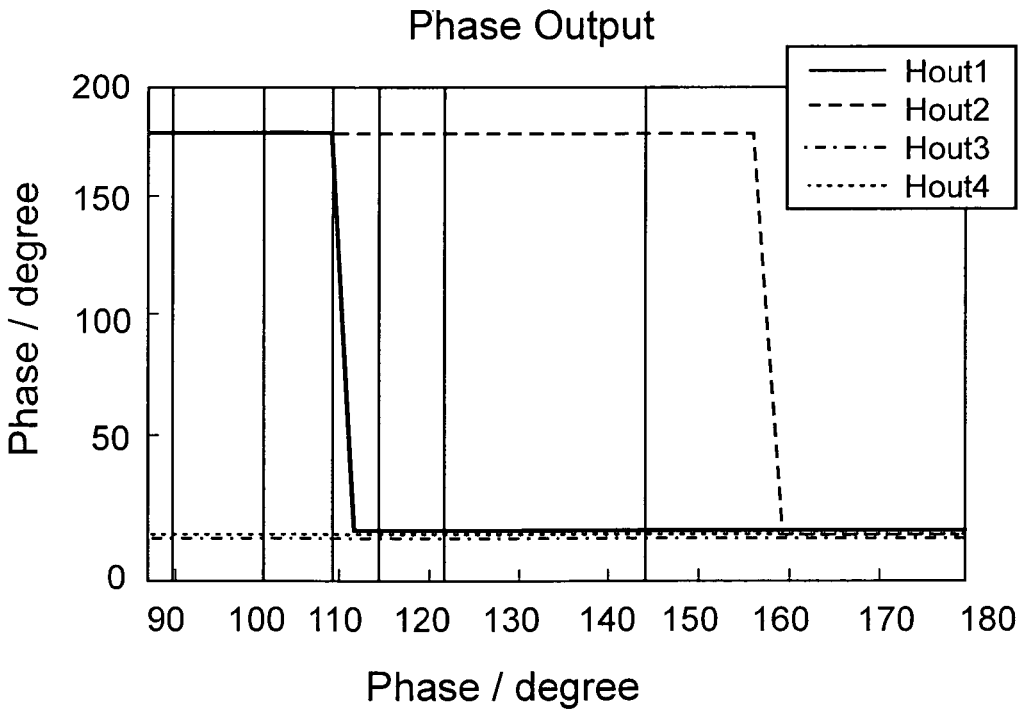
FIG. 16 shows a diagram to illustrate the phase angles of the output signals from the hybrid circuit for the exemplary non-limiting implementation shown in FIG. 12.
Figure 17:
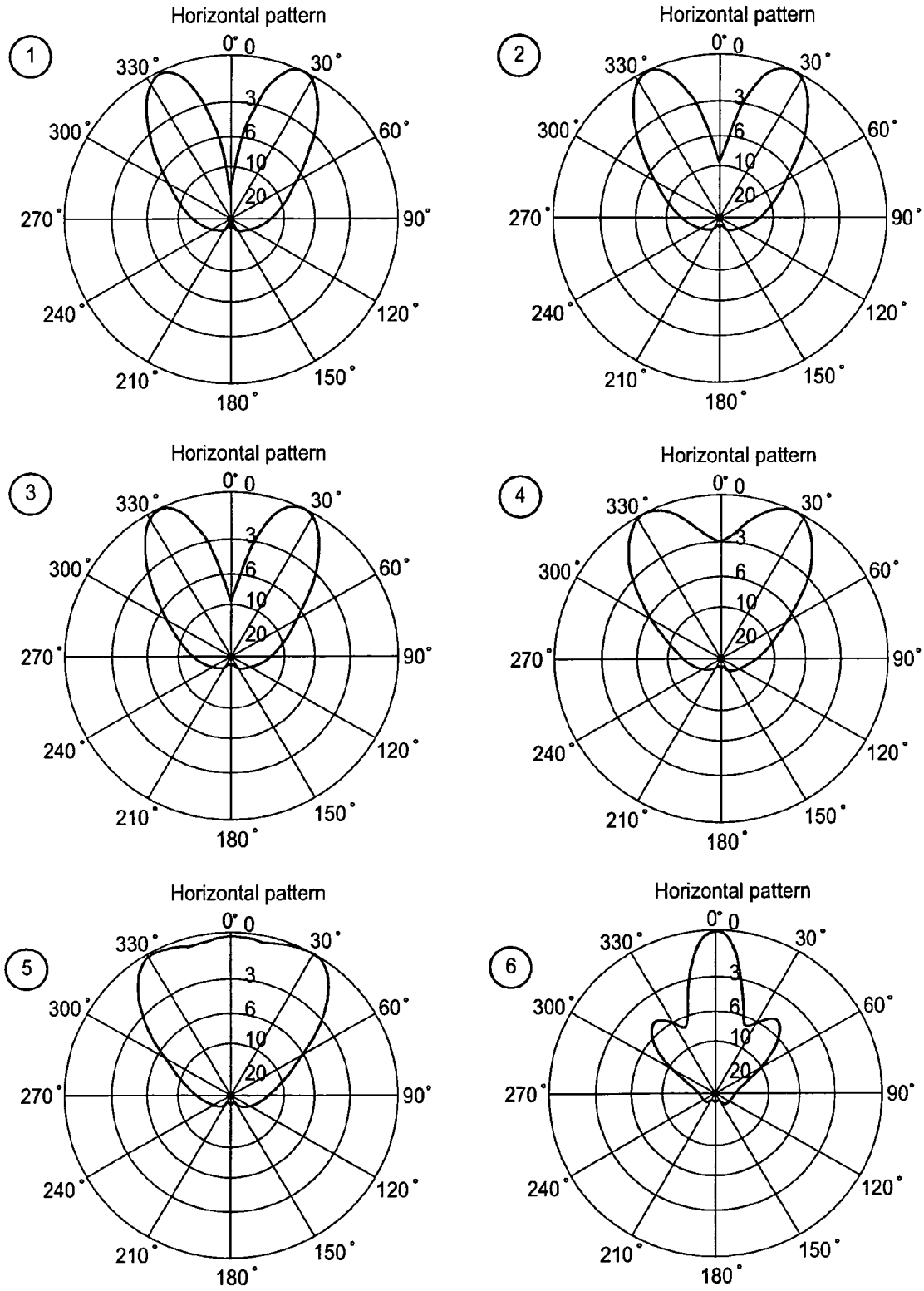
FIG. 17 shows six horizontal polar diagrams which can be produced by the antenna arrangement shown in FIG. 12 with the phase shifter settings annotated by numbers in FIG. 15.

FIG. 15 now shows the different intensity distribution between the output signals $H_{out}$ for the various phase shifter settings between 90° and 180° of the input signals $H_{inA}$ and $H_{inB}$, that is to say of the signals $H_{out1}$, $H_{out2}$, $H_{out3}$ and $H_{out4}$ as they appear at the four outputs I to IV of the Butler matrix, and thus at the inputs of the antenna columns. FIG. 16 in this case shows the phase angles of the signals. The horizontal polar diagrams as shown in FIGS. 17.1 to 17.6 can then be produced corresponding to the positions as identified by the numbers "1 to 6" in FIG. 15.

This also means that widely differing horizontal polar diagrams can be produced with the extreme variability, allowing wide adaptation capabilities.

An additional phase setting or phase adjustment for the various antenna inputs I to IV can also be provided for the last exemplary non-limiting implementation mentioned, in order to make it possible to carry out a further polar diagram change, or polar diagram shaping.

Figure 12:
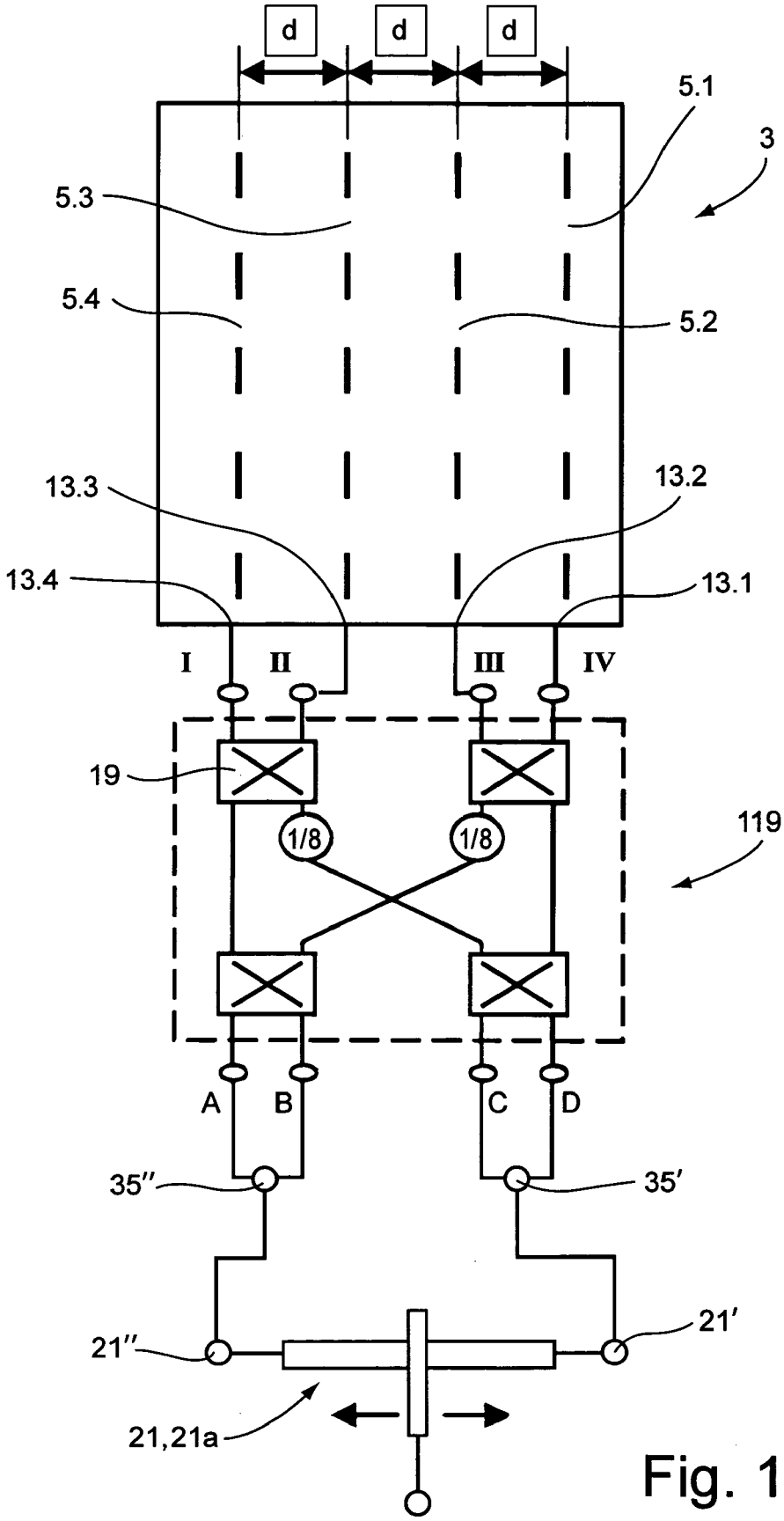
FIG. 12 shows an exemplary non-limiting implementation of the illustrative exemplary non-limiting implementation, once again modified from the exemplary non-limiting implementations as shown in FIG. 1 and FIG. 8.
Figure 18:
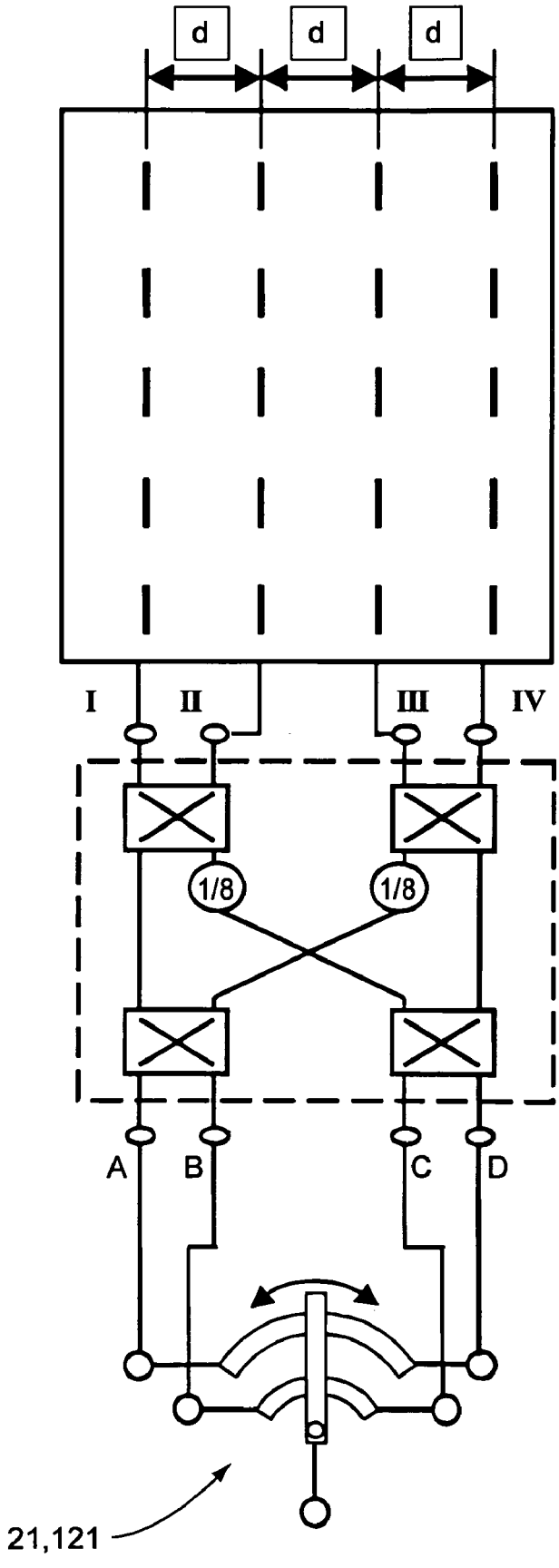
FIG. 18 shows an exemplary non-limiting implementation, once again modified from that shown in FIG. 12, with a double phase-shifter assembly.

A further exemplary non-limiting implementation relating to polar diagram shaping is shown in FIG. 18, in which, in contrast to the exemplary non-limiting implementation shown in FIG. 12, a multiple differential phase shifter 121 (as is in principle known from WO 01/13459 A1) instead of the differential phase shifter 21, as shown in FIG. 12 with subsequent power division. A phase shifter such as this, which is also referred to as a double phase shifter 121, then has four outputs, in which case a different phase angle can be produced at the first pair of outputs to that at the second pair of outputs. Furthermore, a multiple phase shifter such as this may also provide integrated power splitting, as is also known in principle from WO 01/13459 A1. The different power splitting and/or the different volume length of the different phase shifting using a multiple phase shifter such as this thus allows the input signals for the hybrid network to be set differently, in a corresponding manner.

Instead of a multiple phase shifter such as this, as explained, two or more individual phase shifters can also be used and are connected to one another, for example, via a step-up drive. This makes it possible, for example, to produce a step-up ratio of 1:2 or else, for example, 1:3, as desired, so that only one adjustment process need be carried out in order then to produce various phase angles at the outputs of the two or more phase shifters, in the factory.

A further large number of different polar diagrams can then be produced by interchanging the connection between the outputs of the network I to IV and the inputs 13.1 to 13.4 of the antenna 3.

Figure 19:
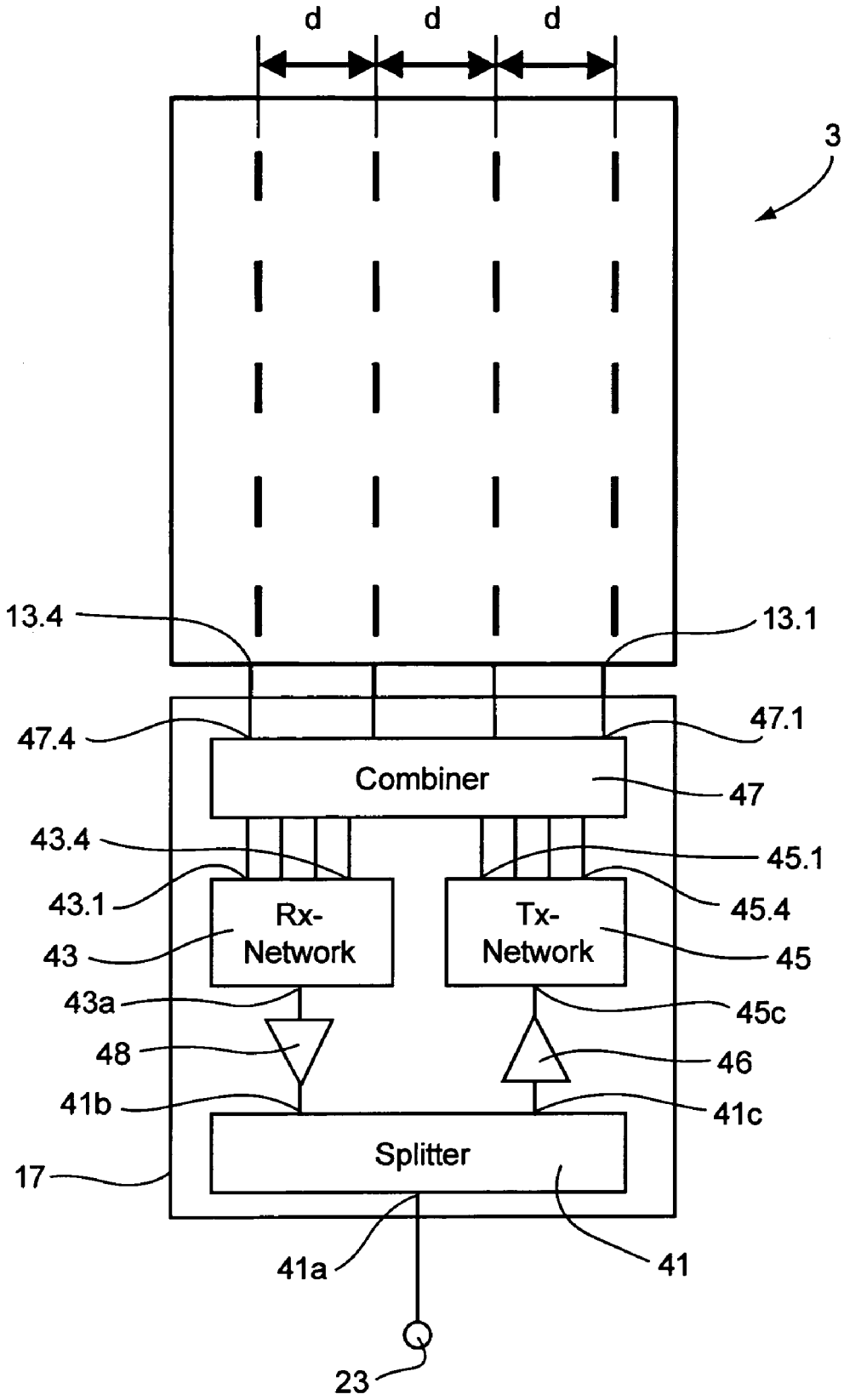
FIG. 19 shows a further exemplary non-limiting implementation to illustrate how beam shaping can be carried out differently for reception and transmission.

The following text refers to FIG. 19. FIG. 19 describes a further exemplary non-limiting implementation, in which two different polar diagram shapes are produced with one antenna, for example for transmission and for reception.

In this exemplary non-limiting implementation, the network 17 upstream from the antenna 3 has a duplex filter 41, whose input 41*a* is connected to the input 23 of the network. The duplex filter also has two outputs 41*b* and 41*c*, which are respectively connected to a receiving network 43 (RX network) and to a transmitting network 45 (TX network) via a respective line. In this case, a transmission amplifier 46 may be arranged between the output 41*c* of the duplex filter 41 and the input 45*c* of the transmitting network 45.

In the illustrated exemplary non-limiting implementation, the transmitting network 45 has four outputs 45.1 to 45.4, which are connected to four inputs of a duplex filter 47. In the other path, the duplex filter 47 is likewise connected via four outputs to four corresponding inputs 43.1 to 43.4 of the transmitting network 43, in which case with a receiving amplifier 48 can once again be connected between the output 43*a* of the transmitting network 43 and the corresponding input 41*b* of the duplex filter 41.

The four antenna inputs 13.1 to 13.4 are connected via four lines to the input/output connections 47.1 to 47.4.

Figure 20:
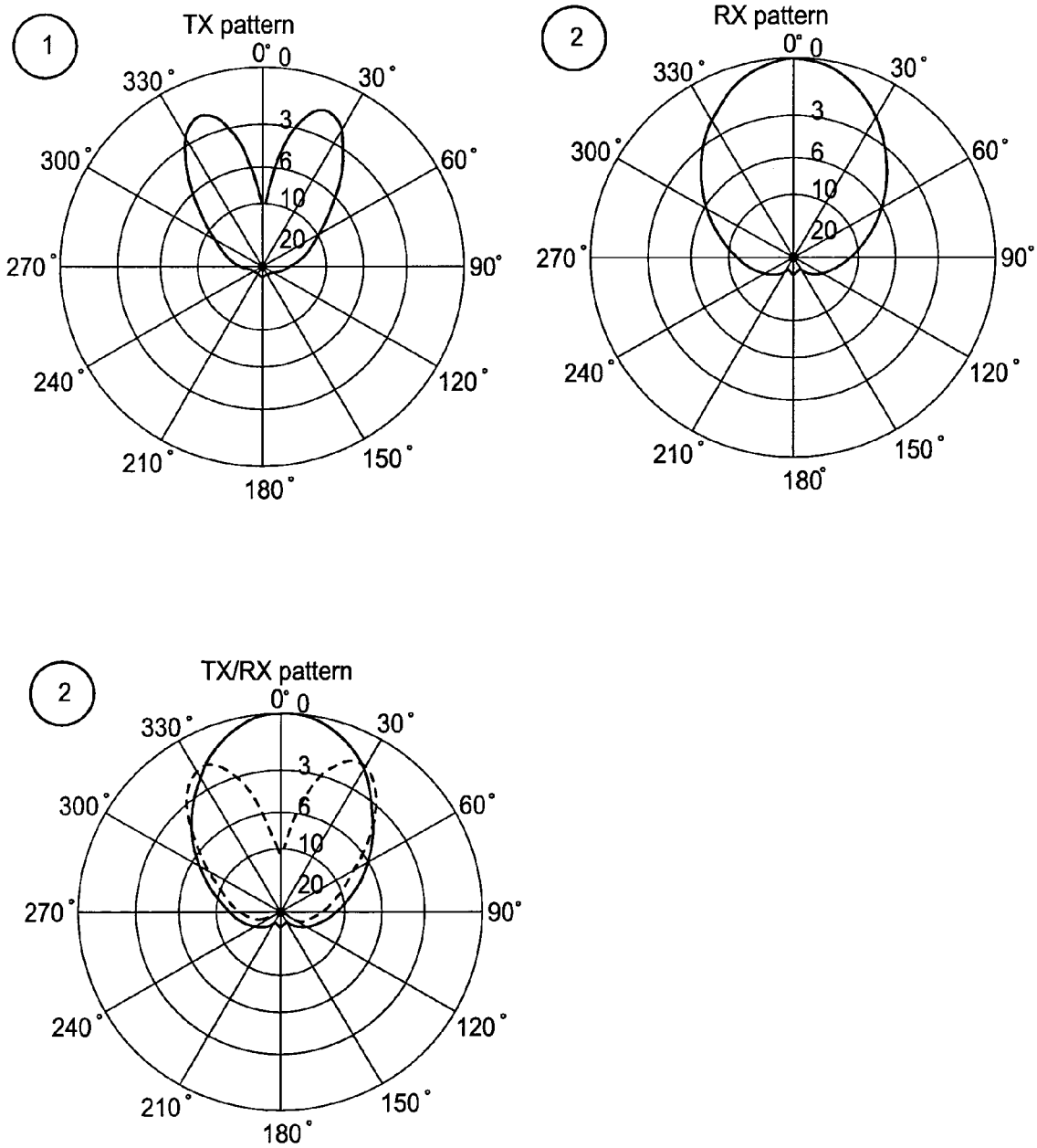
FIG. 20 shows three polar diagrams to illustrate beam shaping for transmission, reception, and a superimposed illustration to show the differences on transmission and reception.

This arrangement therefore allows different horizontal polar diagrams to be produced for reception and transmission, as is shown in FIGS. 20.1 to 20.3.

By way of example, the power density is reduced for transmission (TX) with an azimuth angle of 0° (0° direction). In the case of a mobile telephone that is located in this direction, this would lead to an increase in the transmission power, since the base station would likewise receive a weaker signal in this direction when using the same reception polar diagram (RX polar diagram) and send a signal to the mobile telephone to increase the transmission power.

However, this can be avoided by means of the circuit according to the illustrative exemplary non-limiting implementation, as explained, by using a second polar diagram for reception (also RX), which has high sensitivity. By way of example, FIG. 20.1 shows the horizontal polar diagram for transmission (TX pattern), with the reduced transmission power at the azimuth angle of 0°. In this case, this results in a polar diagram being produced which is symmetrical with respect to the 0° plane, and has two main lobes which are aligned such that they point outwards with respect to the common vertical center plane (=0° azimuth angle). By way of example, FIG. 20.2 shows the reception polar diagram. Finally, FIG. 20.3 shows the overlapping polar diagram as can be seen from FIGS. 20.1 and 20.2, shown jointly, indicating that the two polar diagrams overlap in the main lobe directions but that, as desired, the transmission power is set to be lower although the reception power is still optimum, in a possibly critical zone, which is shown in FIG. 20.1.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. Antenna arrangement comprising:

at least four antenna element systems each being at least one antenna element arranged offset with respect to one another, at least in the horizontal direction, the at least four antenna element systems transmitting and receiving at least in one common polarization plane, a network, via which the at least antenna element systems can be supplied with a signal with an intensity or amplitude which can be adjusted relative to one another, said network including a differential phase shifter, wherein the network is arranged such that a different beam shape is used for receiving signals transmitting signals.

2. Antenna arrangement comprising:

at least four antenna element systems each having at least one antenna element, said elements being arranged to be offset with respect to one another, at least in the horizontal direction, the at least four antenna element systems transmitting and receiving at least in one common polarization plane, a network, via which the at least four antenna element systems can be supplied with signals with an intensity or amplitude which can be adjusted relative to one another, the network having a phase adjusting device connected to receive an input signal, said input signal being split into at least two output signals with the same intensities but with different phase angles, and at least one hybrid circuit, via which the output signals are converted to hybrid output signals which are at relatively fixed predetermined phase angles with respect to one another and whose amplitudes differ from one another as a function of the different phase angles in the phase adjusting device, the at least one hybrid circuit comprising at least four hybrid circuits combined to form a Butler matrix, via which a four-column antenna array can be fed, in which an input signal which can be supplied to the input of the phase shifter adjusting device is split into two phase output signals and in that each output of the phase adjusting device is connected to two inputs of the Butler matrix via a respective downstream branching or addition point.

3. Antenna arrangement according to claim 2, wherein the phase adjusting device comprises a differential phase shifter.

4. Antenna arrangement according to claim 2, wherein the antenna elements are arranged in front of a common reflector arrangement.

5. Antenna arrangement according to claim 2, wherein the antenna arrangement has antenna elements which transmit and receive in one polarization.

6. Antenna arrangement according to claim 2, wherein at least two antenna elements are provided and transmit and receive partially in one polarization and partially in a second polarization plane, which is at right angles to the first polarization.

7. Antenna arrangement according to claim 2, wherein dual-polarized antenna elements are aligned at +45° and −45' to the horizontal.

8. Antenna arrangement according to claim 2, wherein antenna elements are provided which transmit and receive in only one frequency band.

9. Antenna arrangement according to claim 2, wherein two or more antenna elements are provided which transmit and receive in at least two frequency bands, preferably in at least two polarization planes.

10. Antenna arrangement according to claim 2, wherein the connecting lines between the outputs of the hybrid circuit and the inputs of the antenna arrangement can be interchanged to produce different horizontal polar diagrams.

11. Antenna arrangement according to claim 2, including a connecting line between the outputs of the network in the form of said hybrid circuits and wherein at least some of the inputs of the antenna arrangement are of different lengths.

12. Antenna arrangement according to claim 2, wherein the beam shape is adjusted variably.

13. Antenna arrangement comprising:

at least four antenna element systems each having at least one antenna element, said elements being arranged to be offset with respect to one another, at least in the horizontal direction, the at least four antenna element systems transmitting and receiving at least in one common polarization plane, a network, via which tae at least two antenna element systems can be supplied with signals with an intensity or amplitude which can be adjusted relative to one another, the network having a phase adjusting device connected to receive an input signal, said input signal being split into two output signals with the same intensities but with different phase angles, and at least one hybrid circuit, via which the output signals are converted to hybrid output signals which are at relatively fixed predetermined phase angles with respect to one another and whose amplitudes differ from one another as a function of the different phase angles in the phase adjusting device, the at least one hybrid circuit comprising at least four hybrid circuits combined to form a Butler matrix, via which a four-column antenna array is fed, with a double or multiple phase shifter arrangement being provided, such that the input signal which can be supplied to the input of the network and hence to the phase shifter adjusting device can be divided into four phase shifter output signals, which can be supplied to the four inputs of the Butler matrix.

14. Method for operating an antenna arrangement, comprising:

varying an input signal via (i) either a phase adjusting device or a phase shifter adjusting device and (ii) a downstream network, such that the signals at the output of the network are either in phase or are not in phase, where the signals are input into antenna element systems to control the shape of the horizontal radiation pattern, said radiation pattern having at least three main lobes or an odd number of main lobes, whose maximum intensities differ from one another by less than 50%, further including using at least four hybrid circuits, via which a four-column antenna array is fed, and further including tapping off two phase shifter output signals at the two outputs of a phase shifter adjusting device, and supplying four resulting signals to four inputs of a Butler matrix.

15. Method according to claim 14, further comprising using a network which has a receiving network and a transmitting network, for setting a horizontal polar diagram which is different for transmission and reception.

16. Method according to claim 15, including producing, during transmission, a horizontal polar diagram which overlaps the horizontal polar diagram which is produced for reception, with the horizontal polar diagram for transmission having a surface area with a lower power density.

17. Method according to claim 14, further including using a double phase shifter arrangement, at whose four outputs four output signals are produced which are supplied to the four inputs of a Butler matrix.

* * * * *